United States Patent [19]

Agnello, Jr.

[11] 3,994,072

[45] Nov. 30, 1976

[54] ILLUMINATED GUNSIGHT

[76] Inventor: Joseph A. Agnello, Jr., 177 N. Highland Ave., Ossining, N.Y. 10562

[22] Filed: Nov. 19, 1975

[21] Appl. No.: 633,589

[52] U.S. Cl. ..... 33/241; 200/158

[51] Int. Cl.[2] ..... F41G 1/34

[58] Field of Search ..... 33/241; 240/6.41; 200/158

[56] References Cited

UNITED STATES PATENTS

| | | | |
|---|---|---|---|
| 1,865,127 | 6/1932 | McKeen | 33/241 |
| 2,385,649 | 9/1945 | Prideaux | 33/241 |
| 2,822,616 | 2/1958 | Gangl | 33/241 |
| 3,698,092 | 10/1972 | Rosenhan | 33/241 |
| 3,833,799 | 9/1974 | Audet | 240/6.41 |
| 3,914,873 | 10/1975 | Elliott, Jr. et al. | 33/241 |

FOREIGN PATENTS OR APPLICATIONS

| | | | |
|---|---|---|---|
| 84,640 | 7/1921 | Germany | 200/158 |

*Primary Examiner*—Richard E. Aegerter
*Assistant Examiner*—Richard R. Stearns
*Attorney, Agent, or Firm*—Israel Nissenbaum

[57] ABSTRACT

A transferable, self aligning battery powered sight using an LED for illumination on a gun barrel.

10 Claims, 9 Drawing Figures

ILLUMINATED GUNSIGHT

This invention relates to illuminated sights for firearms and especially for shotguns.

On the barrel of a rifle, shotgun or handgun there are upwardly protruding sections, usually consisting of metal, which are integral with and are of the same material as the barrel. These are referred to as sights since a shooter aligns his vision along these protrusions for an accurate shot. These sights are usually placed at the end of the firearm barrel furthest from the shooter though a sight may be placed at the beginning of the barrel or at times at both ends. The shape of sights include simple bead-like protrusions usually found on shotguns, tapering or simple blades axially placed on the barrel of a rifle or handgun and blades with a V shaped indentation placed transverse to the barrel. Under low light conditions these sights become difficult for the eye to pick up for proper aiming especially under conditions where a quick shot is desired.

In order to obviate this problem, sights have been illuminated either by a light source external to or contained within the sight structure. However, among devices used on firearms for illuminating sights there are several problems among which are excessive size, excessive cost, permanent placement and at times insufficient or excessive illuminating power.

Prior art illumination for firearms includes flashlight apparatuses which provide light and illuminate the target. These are however bulky and since they do not illuminate the sight but rather the target the use of these devices is illegal in many places. Other devices include the use of radioluminescent materials to illuminate sights, however these materials, though they provide some light, do not provide a bright enough light which a shooter's eye can pick up quickly for a rapid shot under low light conditions. This is especially important in game hunting where the target is usually in motion and is in sight for only a short period of time.

Lights integrated into the barrels of guns exist, however they have the drawbacks of being very expensive with the gun having to be wired and the power source implanted in either the butt or stock of a gun. Additionally once a light is placed in such a manner it is permanently fixed and cannot be used for other firearms.

It is therefore, generally, an object of the present invention to provide a low cost, lightweight, transferable brightly illuminated gunsight using existing gun sights for rapid and dependable affixation and centering.

Other features, properties and objects of the present invention can be discerned from the further description of a preferred embodiment and the drawings of which:

This invention basically comprises low electrical drain light emitting electronic componentry with a drain ranging from 1 to 75 milliamps as compared to the 250 to 500 milliamp drain of average incandescent light bulbs integrated into or on a housing preferably made of a low weight and easily formable plastic such as nylon which also has insulative properties. These low drain light emitters include light emitting diodes (LED's), liquid crystal displays (LCD's) and the like. The housing is constructed to fit the curvature of a gun barrel and to have the properties of removability for use with more than one firearm, and the immediate and simple centering and anchoring of the sight in position for utilization.

Figure 2:
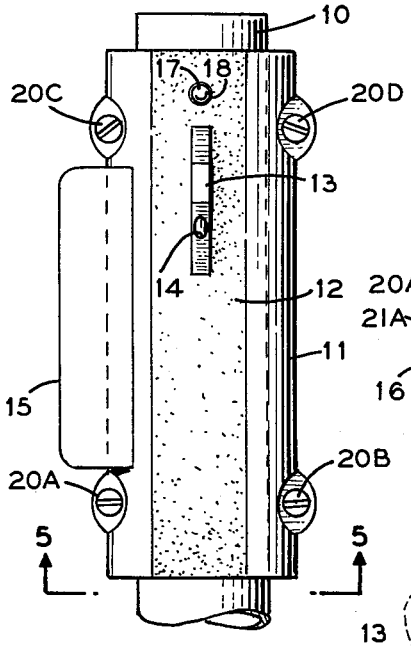
FIG. 2 is a plan view of the sight of FIG. 1.
Figure 5:
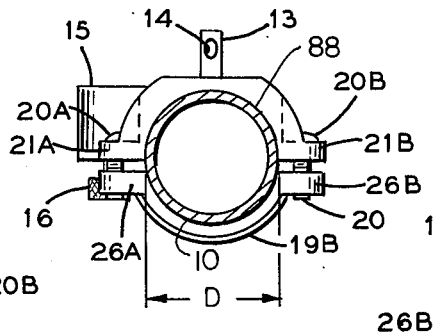
FIG. 5 is an end view taken along 5—5 of FIG. 2.
Figure 1:
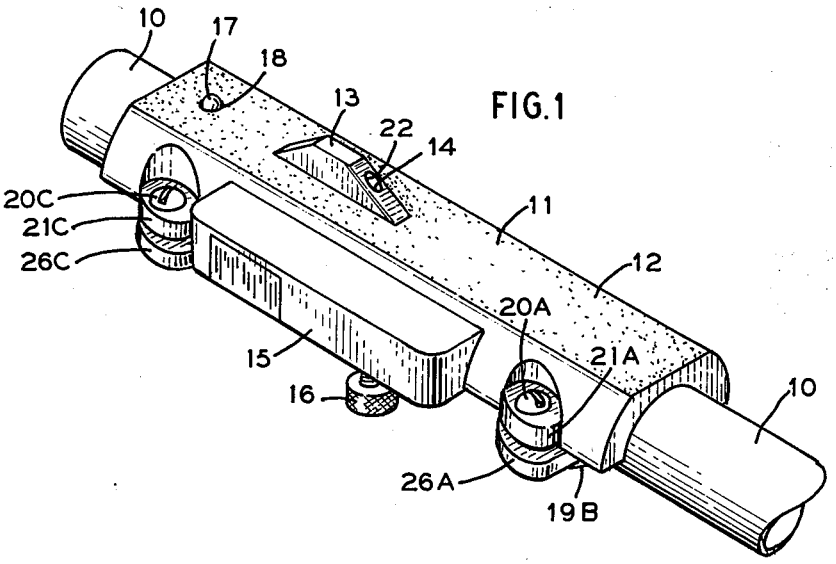
FIG. 1 is an perspective view of the sight on a shotgun barrel.

The sight apparatus of the present invention consists, in the preferred embodiment, as shown in FIG. 1, of a cylindrical half or partial shell 11 as sight support shaped to fit a shotgun barrel 10. The half shell 11 is made of a partially flexible material which permits the use of the sight with guns of varying diameters such as injection molded nylon, acetal, glass filled ABS and polycarbonate which also have good high and low temperature characteristics, impact and wear resistance. As shown more clearly in FIG. 5 the curvature, 88, which is shaped to fit a gun barrel has a resiliency enabling it to be used with gun barrels of differing bores. For example, the device as shown in the drawings with a diameter D of 0.89 inch can be fitted to 12, 16, and 20 gauge shotguns. Shotguns having double barrels can be accomodated with a sight support having an elongated central portion in the cylindrical half shell configuration. The half shell 11 has a flattened surface 12 which lies directly upon the upper surface of the gun barrel 10 and which flat configuration reduces the elevation of the sight from the gun barrel. This flat area 12 is preferrably of a non-glare matte finish formed for example by cross hatching the surface area and supports a protruding blade or sight 13 which contains a light emitting diode (LED) 22. An integral side casing 15, molded of the same material as the main body of the sight support is shown as being rectangular in shape and contains the circuitry and power supply for the LED. The LED or other illuminating device is turned on and off by a screw switch 16, which will advantageously be a threaded member as described hereinbelow.

Figure 3:
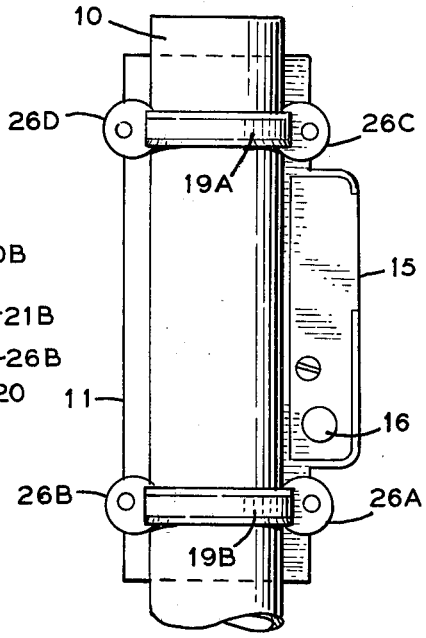
FIG. 3 is a bottom plan view of the sight.
Figure 4:
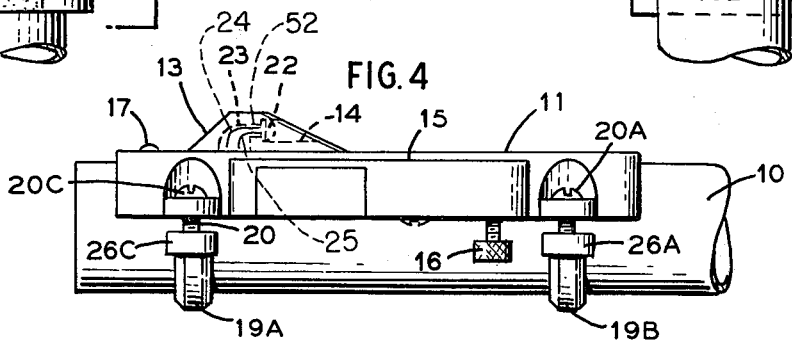
FIG. 4 is a side elevation of the sight.
Figure 8A:
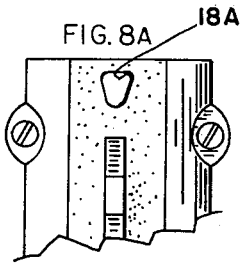
FIGS. 8A and 8B are modifications of the sight centering aperture.
Figure 8B:
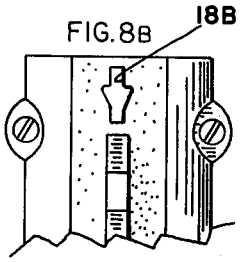

The half shell 11 is affixed to the gun barrel by suitable means such as two interchangeable holding straps 19A and 19B, shown more clearly in FIGS. 3 and 4 made of a material similar to that of the sight and interchangeable screws 20 A–D. The holding straps are symmetrically disposed and made to fit engagingly by means of threaded eyelets 26 A–D with correspondingly positioned eyelets 21 A–D in the sight support. The screws 20 A–D are passed through the corresponding eyelets of the sight support and threaded into the holding straps or vice versa until the entire structure is solidly supported on the gun barrel. It is preferable that nylon or other plastic screws be used in conjunction with the plastic material of the sight support and holding straps for better engagement and minimization of corrosion. Though the use of holding straps is preferred because of their more positive holding power other means of affixation are contemplated such as the use of resilient jaws capable of snapping around the gun barrel. In the present embodiment an additional means for holding the assembly in place as well as a means for automatically centering the sight on the gun barrel in a positive position is effected by molding the half shell with an aperture 18 directly forward of the sight and specifically shaped to accomodate the existing sight as a bead 17 as found on shotguns and the aperture 18 is circular to accomodate such bead. The shape of the hole 18 can be varied such as by making it shaped as shown in FIG. 8A as 18A to hold beads of various sizes or slitted to hold blades and other types of sights found on pistols and rifles, or a combination of shapes for more universal application as shown as 18B in FIG. 8B.

It is preferred that the LED 22 or other light emitting device be recessed within space 14 in the opaque sight blade 13 to minimize diffusion of light to the sides of the LED. This enables the shooter's eye to immediately pick up the LED as a sharp reference point and thereby improve the aiming of the gun. Additionally when the present invention is utilized in conjunction with firearms utilized by law enforcement personnel the recessed LED prevents any inadvertant "giving away of position" since the sight is visible only to the rear and therefore only to the user.

FIG. 4 shows the placement of the LED 22 in the sight 13. The diode 22 is placed in the circular recess 14 until the base of the diode engages the narrower recess 52. The curved area 23 to the rear of the recesses facilitates the insertion of the diode lead wires 24 and 25 and their positioning down through the sight 13 and then along the underside of the sight support as fully depicted in FIG. 6. After the LED is in place, recess 52 can be filled with an encapsulating material such as Silastic 732, Scotch Cast No. 5 and Hiper 270 to protect the LED during use against displacement. FIG. 4 also depicts the positioning of the diode relative to existing sight 17 on gun barrel 10. It can be noted that the relative height differential is slight and thus any parallax differential is thereby minimized.

Generally the anode of the diode or diode-can terminal is electrically connected to the cathode of a battery and the cathode of the diode connected to the anode of the battery. A resistor is placed in the circuit to limit the current. Circuit connection is made by contact strips being connected with a metallic screw spanning both with movement of the screw serving as an off switch.

Figure 6:
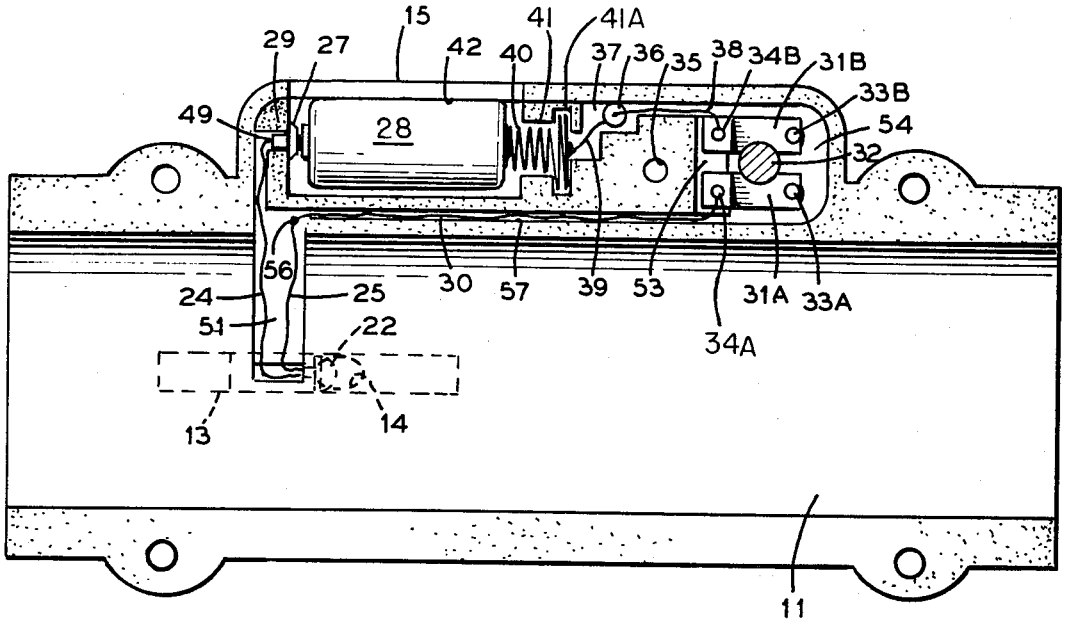
FIG. 6 is an enlarged bottom plan view of the sight with the electrical compartment bottom removed for clarity.

FIG. 6 shows the sight apparatus 11 from the bottom with the bottom of the casing 15 removed to show the electrical componentry. The LED 22 is shown as being visible by dotted lines with its leads 24 cathode and 25 anode being elongated and drawn first through the groove 51 which is a shallow arcuate groove molded in the underside of the sight support 11. Lead 24 is connected to terminal contact 29 by welding, soldering or other similar method of electrical connection. Terminal contact 29 which is snugly seated into recess 49 is preferably rivet shaped with a circular head 27 having bevelled edges for ease of insertion of battery 28 into the hollow cavity 42. The bevelled edge permits the anode end of the battery to easily slide into proper position as shown and therefore in good electrical contact with terminal contact 29 and the cathode end with spring 40 with the latter acting as both terminal connection and resilient support for the battery 28. The spring 40 preferably has a widened base which fits into the enlarged section 41A of cavity 41 and is held in position thereby while resistor 36 is electrically connected to said spring by connecting wire 39. Resistor 36 is preferably placed in an upright position in cavity 37 to conserve space and in the present embodiment has a resistance of 100 ohms which is a compromise between diode brightness and battery life through other resistances are within the ambit of the present invention. Resistor 36 is electrically connected to metallic contact strip 31B by means of connecting wire 38. Contact strips 31A and 31B are step shaped as more clearly shown in FIG. 7 extending from elevated portion 53 to lower base area 54. Contact strips 31A and 31B are seated upon plastic protrusions 33A, 34A and 33B, 34B respectively with the contact strips having holes corresponding to and coinciding with said plastic protrusions when said strips are seated thereupon. The plastic protrusions are thermally deformed after the contact strips have been seated to solidly hold said strips in position. When contact strips 31A and 31B are in place they are put electrically in contact by means of a metallic screw with a flat base and a knurled and thickened head, for ease of manipulation, not shown in FIG. 6 but shown in FIGS. 1,4,5 and 7 as screw 16. The area of contact between the screw and contact strips 31A and 31B is shown as area 32. To complete the circuit, lead 25 is elongated by electrical connection at point 56 to wire 30 which is drawn through the narrow groove 57 and electrically connected to contact strip 31A. When leads 24 and 25 and wires 30 and 39 are in place an encapsulating layer such as described above is applied to grooves 51 and 57 and to the area 37 surrounding the resistor to prevent untoward movement and possible disconnection of the electrical contact points under shock conditions such as may occur when the firearm is discharged.

Figure 7:
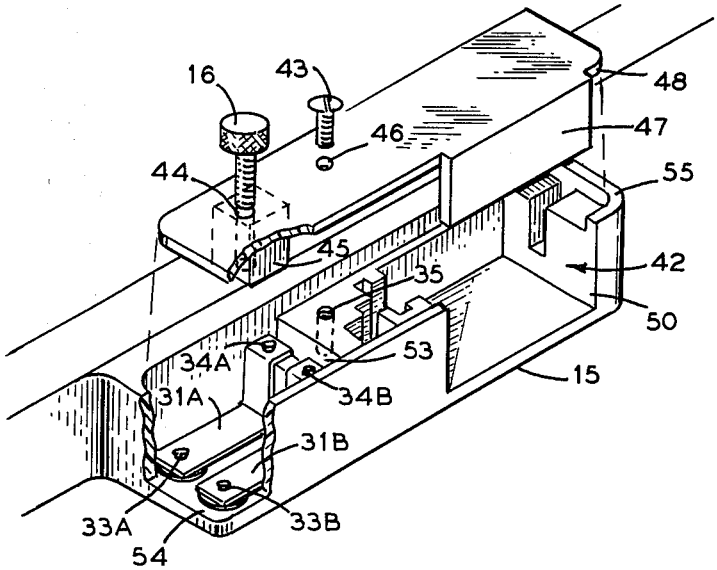
FIG. 7 is an enlarged exploded perspective view of the electrical compartment.

The side casing 15 of FIGS. 1-6 is shown in both enlarged and exploded form with sections removed for clarity in FIG. 7. The cover 48 is molded with an aperture 46 extending therethrough and a threaded aperture 44 aligned with the latter passing through a rectangular block 45 molded with the cover 48. Cover 48 is also molded with a side lip 47. When the cover 48 is placed on the casing 15 cap screw 43 is passed through aperture 46 and is engaged by the threaded hole 35 to hold the cover fixedly in place. Side lip 47 fits snugly into opening 50, which was made to provide for easy access for removal and insertion of the battery, thereby holding the inserted battery in cavity 42 in place. The cover 48 is set atop the recessed moldings within ridge 55 for engagement with minimal movement once the cap screw 43 is in place. Contact strips 31A and 31B which are held in place by melted plastic protrusion 33A, 34A and 33B and 34B respectively are elevated at their lower ends above base 54 by reason of the small bases on protrusions 33A and 33B. This angular elevation allows for positive engagement between the contact screw 16, which is guided into position by the aperture 44 in the block 45, and the contact strips at the point indicated by area 32. This means of switching is positive and it is silent and easily manipulable with only a minute distance required for the switching.

It is to be understood that the above described invention can be modified within the spirit of the invention and that the various features for manufacturing purposes present only a preferred modification of this invention.

What is claimed is:

1. An illuminated gunsight comprising an electrically powered, light emitter with a low electrical drain ranging from 1 to 75 milliamps; means for supporting said light emitter on a gun barrel with said supporting means comprising an elongated, generally cylindrical flexible half shell adapted to fit on the upper portion of a gun barrel, said half shell having an upper surface with an outward protrusion on said upper surface, and said protrusion having a recess therein into which said light emitter is fixedly placed, with said protrusion thereby forming a sighting member; means for positioning said supporting means so that said light emitter is centered on said gun barrel; means for removeably mounting said supporting means on said gun barrel; and an electrical power source for said light emitter with an electrical connection therebetween, said electrical connection having an electrical switching element.

2. An illuminated gun sight as in claim 1 wherein said low drain light emitter is a light emitting diode.

3. An illuminated gun sight as in claim 1 wherein said cylindrical half shell has a planar surface with said protrusion upon said surface.

4. An illuminated gun sight as in claim 3 wherein said planar surface has a non-glare finish.

5. An illuminated gun sight as in claim 1 wherein said recess is of a depth such that said light emitter is fully recessed within said recess.

6. An illuminated gun sight as in claim 1 wherein said centering means comprises an aperture in said supporting means to accomodate the existing sight of said gun barrel.

7. An illuminated gun sight as in claim 1 wherein said means for removeably mounting comprises one or more straps separably connected to said supporting means with said connection peripherally enclosing said gun barrel within a space defined by said straps and said supporting means.

8. An illuminated gun sight as in claim 1 wherein said power source comprises one or more electrical cells, said cells being contained within a casing which is integral with said supporting means.

9. An illuminated gun sight as in claim 1 wherein said electrical connection includes at least 2 metallic contact strips.

10. An illuminated gun sight as in claim 9 wherein said electrical switching element is a metallic screw with the end of said screw being adapted to span and contact said strips.

* * * * *